United States Patent [19]

Kohaut et al.

[11] Patent Number: 4,621,022

[45] Date of Patent: Nov. 4, 1986

[54] EXPANDABLE PLASTICS GRANULAR MATERIAL HAVING AT LEAST ONE ORIFICE

[75] Inventors: Günter Kohaut, Königstein; Werner Weber, Nauheim, both of Fed. Rep. of Germany; Herman Groenendijk, Oosterhout, Netherlands; Adrianus C. Poppelaars; Wilhelmus H. J. Janssen, both of Breda, Netherlands

[73] Assignee: Hoechst Aktiengesellschaft, Fed. Rep. of Germany

[21] Appl. No.: 823,467

[22] Filed: Jan. 28, 1986

[30] Foreign Application Priority Data

Jan. 30, 1985 [DE] Fed. Rep. of Germany ..... 3503057

[51] Int. Cl.[4] ..... B65D 81/02; B65D 85/30

[52] U.S. Cl. ..... 428/397; 206/523; 206/584; 206/814; 428/398; 428/402

[58] Field of Search ..... 206/523, 584, 814; 428/397, 398, 399, 402

[56] References Cited

U.S. PATENT DOCUMENTS

| | | | |
|---|---|---|---|
| 3,400,037 | 9/1968 | Sare et al. | 428/534 |
| 3,855,053 | 12/1974 | Fuss | 428/340 |
| 3,961,000 | 6/1976 | Ropiequet | 428/402 |
| 4,269,895 | 5/1981 | Borchert et al. | 428/402 |
| 4,500,586 | 2/1985 | Bussey, Jr. | 428/402 |

*Primary Examiner*—William J. Van Balen

*Attorney, Agent, or Firm*—Connolly and Hutz

[57] ABSTRACT

The invention relates to a plastics granular material of foamable particles which are derived from a star-shaped basic body with at least three limbs lying in a plane, the particles having at least one orifice. Preferably, these granular material particles are provided with three limbs and each limb is provided with an orifice.

Furthermore, the invention has as its subject a packaging material which is obtained by foaming of the said plastics granular material. This packaging material displays a lower bulk density, improved pourability with simultaneously improved packing effect (good packaging properties, large void volume).

17 Claims, 9 Drawing Figures

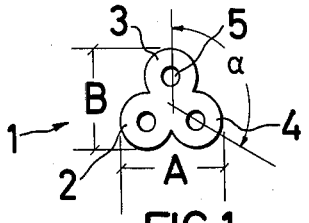
FIG.1
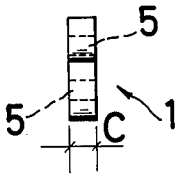
FIG.2
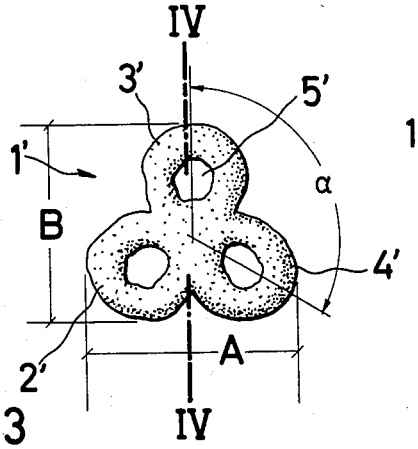
FIG.3
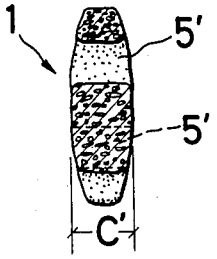
FIG.4
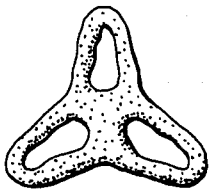
FIG.5
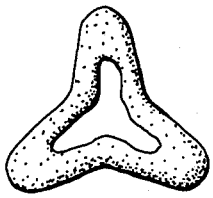
FIG.6
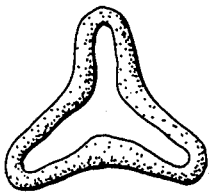
FIG.7
FIG.8
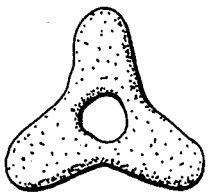
FIG.9
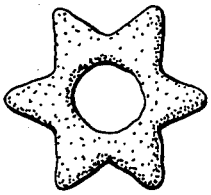

EXPANDABLE PLASTICS GRANULAR MATERIAL HAVING AT LEAST ONE ORIFICE

Packaging or filling materials of loose expanded plastics particles are known and are used in large quantities. Decisive factors for this are, in particular, their freedom from dust, the resistance against moisture and mold formation, the abrasion resistance and their inert behavior with respect to the article packaged and their low weight. Usually, such plastics particles are supplied as compact, nonexpanded granular materials containing a blowing agent and are only expanded by known processes to the final form in the packaging plant.

The effect of the foamed plastics particles as a packaging material is founded on the fact that, after bedding down the article packaged, they interlink or intermesh and, in addition, enclose a large void volume. The void volume involved here is the volume enclosed, but not filled by the particles when they are poured out into a loose heap. A type of "resilient envelope" is thereby formed around the article. The intermeshing with simultaneous formation of a large void volume is particularly important for preventing the "wandering" of the packaged object through the package particles, owing to transportation vibration, and for achieving an optimum, lasting "spring effect".

In contrast to the capability of intermeshing with other particles, thereby forming a large void volume, is the requirement that the particles forming the packaging material at the same time also have a good pourability. The light, foamed plastics particles are namely usually introduced into the respective packaging containers in free fall from storage bins. This is conditional on a perfect pourability of the particles, as otherwise a "bridge formation" takes place in the storage bunker due to interlinking of the particles and the even flowing-out, and thus the metering of the particles, is disturbed or prevented. This results in sensitive disturbances, particularly on fully automatic packing lines.

It has been attempted to meet these contradicting requirements on the packaging material, in other words a good pourability in removal from the storage container at the same time as large void volume and good interlinking or intermeshing of the particles in the packaging container, by certain shaping of the foamed plastics particles. The following may be mentioned as examples of the shape of the particles: S shape, Y shape, star shape, corrugated elongate or round leaves, rings, split rings, 8-shaped hollow bodies, spiral bodies, particles in the shape of potato chips, semispheres, saddle-shaped particles, dumbbell-shaped particles and flakes.

Although the abovementioned particle shapes frequently display satisfactory intermeshing properties with acceptable pouring property, the void volume, essential for the packing behavior, remains below the desired magnitude.

The object of the invention was therefore to avoid the disadvantages of the known particle shapes and to provide in particular a foamed plastics granular material which, after expansion, produces a packaging material which has a good pourability, a good intermeshing property and at the same time a large void volume of the poured-out fill.

To achieve this object, the invention proposes a plastics granular material of foamable particles in star shape comprising predominantly particles which are derived from a star-shaped or cloverleaf-shaped basic body with at least three limbs lying in a plane, the particles having at least one orifice (a hole).

The invention relates further to the use of these foamable plastics granular materials for the production of correspondingly expanded packaging materials and the expanded packaging materials themselves thereby obtained. The number of limbs according to the invention is at least three, in particular three, four, five or six. Preferred according to the invention are granular material particles which are of three-limbed or six-limbed design.

The orifice(s) of the granular material particles according to the invention may be located in one of the limbs or in the center of the granular material particles. Preferred according to the invention are parts which have orifices in all limbs; preferred furthermore are such particles in which the orifice is located only in the center, which applies in particular to six-limbed particles. Wherever the orifices are only relatively small and their size varies in the lower part of the ranges stated below, it may be favorable in some cases to make an orifice in the center of the granular material particles as well as the orifices in the limbs.

The orifices are preferably of predominantly round to oval or lenticular shape; however, in principle other shapes are possible, such as polygons, for example triangles, rectangles, hexagons etc.

The size of these orifices is generally to be dimensioned such that their area is about 25% to about 75%, preferably 30% to 60%, referred to the respective limb area or to the total area in the case of just an orifice in the center. The diameter or the maximum clear span of these orifices is usually 0.2 to 2.0 mm, preferably 0.3 to 1.5 mm.

The wall thickness (length of cut) of the granular material particles according to the invention is generally in the range from 2.5 to 7.0 mm, preferably 3.0 to 6.0 mm.

The dimensions (A), (B) and (C) in the case of three-limbed granular material particles (cf. FIGS. 1 and 2) are usually 4 to 6.5 mm, 4 to 6 mm and 2.5 to 7 mm. The corresponding preferred values are 4.5 to 6 mm (A), 4.5 to 5.5 mm (B) and 3 to 6 mm (C). The angle $\alpha$ between the limbs 1 and 2 (FIG. 1) varies expediently between 100° and 140°, preferably 110° and 130°.

In general, with three-limbed granular material particles, the ratio of (A) to (B) is 1:0.6 to 1:1.5, preferably 1:0.75 to 1:1.25, the ratio of (A) to (C) is 1:0.4 to 1:1.75, preferably 1:0.5 to 1:1.4, and the ratio (B) to (C) is 1:0.4 to 1:1.75, preferably 1:0.6 to 1:1.35.

The dimensions, angles and dimensional relationships in the case of four-limbed, five-limbed, six-limbed and multi-limbed particles correspond entirely.

As stated, the limbs of the granular material particles according to the invention lie in a plane. Without departing from the scope of the invention, at least one part of it may, however, also have a slight convexity, for instance such that all limbs deviate in the same direction from an imaginary plane. At the same time, in some particles individual limbs may also be curved with respect to one another. The angle of curvature (deviation from the plane) is at maximum 20°, preferably at maximum 10°.

Suitable as plastics for the particles according to the invention are the thermoplastics usually used for packaging materials, such as for example styrene polymerizates, polyolefins such as polyethylene, VC polymerizates and the like. Polystyrene is used with preference.

The production of this foamable, compact plastics granular material containing a blowing agent is performed in a known way by melting the plastic in an extruder, introducing under pressure a metered amount of a suitable blowing agent into the plastic melt, extruding the melt containing the blowing agent through an appropriate star-shaped (cloverleaf-like) die and subsequent granulating. This die is provided with cores (mandrels), the shape and number of which correspond to those of the desired orifices. To prevent an expansion during extrusion, the strands emerging from the extruder are quickly cooled, expediently by a waterbath. The length of the most favorable waterbath section and the drawing-off speed of the strands are easy for a person skilled in the art to determine by a few routine tests. Subsequently, the cooled strands are cut perpendicular to the drawing-off direction into particles of the above-specified thickness. The strand temperature here should expediently be chosen such that the proportion of dust and splinters on cutting is as small as possible.

The expandable particles thereby produced can be expanded into the packaging material bodies according to the invention by heating above their softening point, for example by steam. Usually, this foaming is not carried out until it reaches the consumer. Instead of a physical blowing agent, a chemical blowing agent, which separates gases upon heating, for example steam, carbon dioxide or nitrogen, may be mixed into the plastic prior to extrusion.

The packaging material obtained consists predominantly, preferably to more than 90%, and in particular to more than 95%, of particles of the shape described above, i.e. of the shape of a star-shaped particle with three, four, five or more, preferably three or six, limbs lying in a plane, each limb having at least one orifice (a hole). Slight deviations from the plane shape, as described in the case of the granular material particles, are also possible here.

The wall thickness of the particles of the packaging material according to the invention is generally 8 to 20 mm, preferably 10 to 16 mm, the wall thickness generally being largest at the center of the particle and decreasing towards the edge regions. Under some circumstances, this decrease may amount to up to 70%, in particular up to 50%.

The dimensions (A'), (B') and (C') in the case of three-limbed particles (cf. FIGS. 3 to 5) are usually 16 to 40 mm, 16 to 40 mm and 8 to 20 mm. The corresponding preferred values are 20 to 38 mm (A'), 18 to 36 mm (B') and 10 to 18 mm (C'). The angle $\alpha'$ between the limbs 2 and 4 (FIG. 3) varies expediently between 100° and 140°, preferably 100° and 130°.

Generally, in the case of three-limbed particles, the ratio of (A') to (B') is 1:0.4 to 1:2.5, preferably 1:0.5 to 1:1.8, the ratio of (A') to (C') is 1:0.2 to 1:1.25, preferably 1:0.26 to 1:0.9 and the ratio (B') to (C') is 1:0.2 to 1:1.25, preferably 1:0.25 to 1:1.

The dimensions, angles and dimensional relationships in the case of four-limbed, five-limbed, six-limbed and multi-limbed particles correspond entirely.

The orifices in the packaging material particles are—corresponding to those in the granular material particles—preferably round, oval and/or lenticular and are found preferably on all limbs or only the center has preferably one orifice. The area of this orifice (these orifices) is, as a rule, about 25% to about 75%, preferably 30% to 60%, referred to the respective limb areas or to the total area. The diameter or the maximum clear span of this orifice (these orifices) is usually 3 to 15 mm, preferably 6 to 12 mm. Corresponding to the granular material particles, the center of packaging material particles can also have an orifice if necessary. In principle, the size of the orifices in the packaging material particles, as also in the granular material particles, is not critical and can assume greater or smaller values than the percentage figures specified above, but at the expense of certain disadvantages.

Depending on degree of expansion etc., the surface of the packaging material particles receives a smaller or greater number of break-outs (craters) which arise due to the escaping blowing agent.

The void volume of the unvibrated poured-out fill of the packaging material according to the invention (determined in accordance with the measuring method described further below) is generally more than 60%, preferably 65 to 90%, in particular 65 to 80%.

On account of the star-shaped configuration, provided with orifices, of the packing material bodies according to the invention, not only is a particularly large void volume of the poured-out fill formed, but there results furthermore an elastic deformation behavior of the particles, without a permanent deformation or even a destruction of the foam structure occurring.

The packaging material according to the invention may contain the usual amounts of the usual additives such as flameproofing agents, ultraviolet and heat stabilizers, colorants and externally applicable finishing agents.

The invention will be explained in more detail with reference to the drawings, in which FIGS. 1 and 2 represent a foamable, three-limbed granular material particle, greatly enlarged, while FIGS. 3 to 5 concern the particle obtained therefrom by foaming of the packaging material according to the invention.

The FIGS. 5 to 9 reproduce other inventive developments of expanded particles.

In FIG. 1, which shows a front view of a granular material particle (1) according to the invention, (2), (3) and (4) denote the three limbs of the particle and (5) the orifices. (A), (B) and (C) reproduce the dimensions of the particle in the three directions in space. $\alpha$ represents the angle between the two limbs (2) and (4).

FIG. 2 shows the particle (1) of FIG. 1 in side view. (C) therein denotes the wall thickness (length of cut).

FIG. 3 represents a particle (1') of the packaging material according to the invention, which has been produced by foaming of the granular material particle (1) of FIG. 1. (2'), (3') and (4') in turn denote the three limbs, (5') the orifices, while (A'), (B') and (C') express the dimensions of this particle in the three directions in space. $\alpha'$ reproduces the angle between the two limbs (1') and (3').

FIG. 4 shows the particle (1') of FIG. 3 in section IV—IV. (C') therein denotes the thickness.

FIGS. 5–9 show other geometric forms of granular material particles according to the invention.

EXAMPLES

The packing behavior of foamed plastics particles is substantially determined by the bulk density, the void volume and the pourability. Another important item of information is provided by the cylinder drop test.

In Table 1 below, these values determining the packing behavior of the packaging material according to the invention are compared with those of the packaging material according to German Offenlegungsschrift 2,848,338.

The tests were conducted as follows and are summarized in Table 1:

1. Determination of the bulk density increase of the poured-out fill by vibration A measuring beaker of 10 liters capacity and with the dimensions D=189 mm dia. and H=357 mm was filled with packaging particles in free fall with the assistance of a test funnel. The test funnel consisted of sheet metal with a smooth surface, was provided with a slide gate in the throat and had the following dimensions:

| | |
|---|---|
| large diameter | 850 mm ± 5 mm |
| small diameter | 150 mm ± 5 mm |
| angle of inclination | 45° ± 1° |
| overall height with throat | 700 mm ± 5 mm |
| height of throat | 305 mm |
| distance between slide gate and end of throat | 25 mm ± 2 mm |
| thickness of slide gate | 1.6 mm |

Such a test funnel is described, for example, in "Technische Lieferbedingungen (Technical Terms of Delivery) TL 8135-0032, issue 2 (March 1982)", pages 1 to 6 of the Bundesamt für Wehrtechnik und Beschaffung der BR-Deutschland (Federal Office for Defense Engineering and Procurement of the Federal Republic of Germany).

Thereafter, the top edge of the measuring beaker was leveled off with a rule. The net weight divided by 10 gave the bulk density of the unvibrated poured-out fill in grams per liter.

2. Determination of the bulk density of the vibrated poured-out fill

The measuring beaker described under (1) was filled with packaging particles in free fall with the assistance of the test funnel likewise described under (1). During the filling operation, the measuring beaker was continually knocked against a solid base at short intervals until there was no further volume contraction of the poured-out fill. Thereafter, the measuring beaker was leveled off with a rule. The net weight divided by 10 gave the bulk density of the vibrated poured-out fill in grams per liter.

3. Determination of the compaction of the poured-out fill by vibration (vibrational compaction)

The compaction of the poured-out fill by vibration was given by the quotient (bulk density of vibrated poured-out fill-bulk density of unvibrated poured-out fill) . 100/bulk density of unvibrated poured-out fill in the present cases as:

$$\frac{[6.0\ g/l - 5.4\ g/l] \cdot 100}{5.4\ g/l} = 11.11\%$$

4. Determination of the void volume of the unvibrated poured-out fill

The above measuring beaker was filled with packaging particles as described under (1). After leveling off of the top of measuring beaker with a rule, the measuring beaker was closed with a wire screen. Then the measuring beaker was immersed under water and turned to all sides so that all the voids of the poured-out fill filled with water. The volume of water required for filling the voids corresponded to the void volume of the unvibrated poured-out fill.

5. Determination of the void volume of the vibrated poured-out fill

The said measuring beaker was filled, as specified under (2), and vibrated until maximum particle packing density was achieved. Thereafter, the measuring beaker was immersed under water and turned to all sides so that all voids filled with water. The volume of water required for filling the voids corresponded to the void volume of the vibrated poured-out fill.

6. Determination of the pouring time (flow behavior)

This test was conducted five times. This involved conditioning the foamed plastic particles at standard atmosphere 23/50-2 DIN 50,014 until constant weight was achieved. The throat of the funnel described under (1) was closed by the slide gate and filled to the brim with the material to be tested. Subsequently, the slide gate was pulled out and the time up to complete discharge was measured.

7. Determination of the depth of penetration in the cylinder drop test

The test set-up used for this is described in the company brochure by HOECHST AG "®Hostastar" (September 1981 issue). A 1.65 kg steel cylinder (diameter 44 mm, length 140 mm) was dropped from a height of 1 m into a container filled with packaging particles and briefly vibrated (diameter at the top: 420 mm; diameter at the bottom: 360 mm; filling height: 370 mm).

The cylinder, with longitudinal axis horizontal upon impact, merely caused a brief deformation of the poured-out packaging particle fill and then rebounded, with cushioned effect, from the level of the filling height. Only upon the second impact on the poured-out fill did the steel cylinder penetrate slightly into the fill, but remained fixed in this position (Table 1, packaging material I). The distance from the level of the filling height to the penetrated lower metal line of the steel cylinder is specified as depth of penetration in cm.

8. Springing-back of the cylinder from the surface of the poured-out fill

This assessment criterion allows for good differentiation between the packing and fixing properties of poured-out packaging fills. If there is no springing-back upon the first impact of the steel cylinder on the poured-out fill, the depth of penetration is always greater than in the case of poured-out packaging fills which, on account of their good interlinking and cushioning properties, force the steel cylinder to spring back and only permit very low depth of penetration upon the second or third impact on the poured-out fill resultant from the spring-back.

TABLE 1

| | Dimension | I | A |
|---|---|---|---|
| 1 Bulk density of the unvibrated poured-out fill | g/l | 5.4 | 7.2 |
| 2 Bulk density of the vibrated poured-out fill | g/l | 6.0 | 8.0 |
| 3 Bulk density increase of the poured-out fill by vibration | % | 11.11 | 11.1 |
| 4 Void volume of the unvibrated poured-out fill | % | 69 | 49 |
| 5 Void volume of the vibrated poured-out fill | % | 66 | 44.8 |

TABLE 1-continued

| | Dimension | I | A |
|---|---|---|---|
| 6 Pouring time | sec | 11.5 | 12 |
| 7 Depth of penetration Cylinder drop test | cm | 2 | 4 |
| 8 Springing-back of the cylinder from the surface of the poured-out fill | yes/no | yes | yes |

I = packaging material according to the invention with oval to lenticular orifices in all three limbs; clear span of these orifices approx. 30% to 60% of the respective limb area.
A = packaging material according to German Offenlegungsschrift 2,848,338

It emerges from Table 1 that the packaging particles I according to the invention are superior in bulk density, voil volume, cylinder drop test, depth of penetration and pouring time to the particles A.

We claim:

1. A plastics granular material of foamable particles in star shape, wherein the plastics granular material consists predominantly of particles which are derived from a star-shaped or cloverleaf-shaped basic body with at least three limbs lying in a plane, the particles having at least one orifice.

2. A plastics granular material as claimed in claim 1, wherein at least one of the limbs has an orifice.

3. A plastics granular material as claimed in claim 1, wherein the center of the particles has an orifice.

4. A plastics granular material as claimed in claim 1, wherein the orifice is shaped round to oval.

5. A plastics granular material as claimed in claim 2, wherein the area of the orifice is 25% to 75% of the respective limb area.

6. A plastics granular material as claimed in claim 1, wherein the particles are at least three-limbed.

7. A plastics granular material as claimed in claim 1, wherein the thickness of the particles is 2.5 to 7 mm.

8. A plastics granular material as claimed in claim 1, wherein the granular material particles are three-limbed and one limb is 4 to 6.5 mm, another limb is 4 to 6 mm and another limb is 2.5 to 7.0 mm.

9. A packaging material of foamed plastics particles, obtained by foaming the plastics granular material as claimed in claim 1.

10. A packaging material as claimed in claim 9, wherein at least one of the limbs has an orifice.

11. A packaging material as claimed in claim 9, wherein the center of the particles has an orifice.

12. A packaging material as claimed in claim 9, wherein thickness of the particles is 8 to 20 mm.

13. A packaging material as in claim 9, wherein the particles are three-limbed and one limb is 16 to 40 mm, another limb is 16 to 40 mm and another limb is 8 to 20 mm.

14. A packaging material as claimed in claim 9, wherein, upon pouring out into a loose heap, the void volume of the unvibrated poured-out fill is at least 60%.

15. A packaging material as claimed in claim 9, wherein the particles consist of polystyrene and are expanded with a blowing agent.

16. A plastics granular material as claimed in claim 1, wherein the orifice is lenticular.

17. A plastics granular material as claimed in claim 6, wherein the particles are six-limbed.

* * * * *